United States Patent [19]

Fessenden

[11] 4,197,449

[45] Apr. 8, 1980

[54] FLEXIBLE ELECTRICAL HEATER

[75] Inventor: Peter J. Fessenden, East Longmeadow, Mass.

[73] Assignee: Springfield Wire Inc., Springfield, Mass.

[21] Appl. No.: 922,081

[22] Filed: Jul. 5, 1978

[51] Int. Cl.[2] ..... H05B 3/36

[52] U.S. Cl. ..... 219/549; 219/528; 219/535; 219/541; 219/544; 338/210

[58] Field of Search ..... 219/211, 213, 217, 527, 219/528, 530, 535, 540, 541, 544, 548, 549; 338/210, 274, 285, 303, 323, 324, 326, 328

[56] References Cited

U.S. PATENT DOCUMENTS

| | | | |
|---|---|---|---|
| Re.26,522 | 11/1969 | Fessenden | 219/528 |
| 1,820,602 | 8/1931 | Dick | 219/527 X |
| 1,980,528 | 11/1934 | Hubl | 219/528 |
| 2,022,518 | 11/1935 | Payne | 219/528 |
| 2,619,580 | 11/1952 | Pontiere | 219/549 X |
| 3,125,657 | 3/1964 | Colten | 219/535 |
| 3,191,005 | 6/1965 | Cox | 219/528 |
| 3,249,959 | 5/1966 | Theckston | 219/544 X |
| 3,403,368 | 9/1968 | Scardina | 338/274 X |
| 3,500,444 | 3/1970 | Hesse et al. | 219/544 |
| 3,812,320 | 5/1974 | Borgren | 219/213 |

*Primary Examiner*—Volodymyr Y. Mayewsky
*Attorney, Agent, or Firm*—Chapin, Neal & Dempsey

[57] ABSTRACT

An electrical resistance heater includes a pliable thermally insulative base grooved in a major surface thereof and a flexible electrical resistance heating wire fitted within the groove. The heating wire insulated throughout its length is elastically gripped by the base and the outer surface portion of the heating wire throughout its length extends outwardly of the major surface of the base, providing a unidirectional heat source for use as a "spot heater". Connections of the heating wire to lead wires are disposed within two preformed cavities provided in the major surface of the base. The cavities open in the same direction as the groove and a suitable moisture impervious insulating material disposed within the cavities seals the connections.

5 Claims, 5 Drawing Figures

FLEXIBLE ELECTRICAL HEATER

BACKGROUND

This invention relates to electrical resistance "spot heaters" and particularly to electrical resistance heaters readily conformable to the shape of an object for localized heating.

Heaters for applying heat to localized areas are generally referred to as "spot heaters". Spot heaters have been found to be particularly useful in heating crankcases of refrigerator compressors to maintain the refrigerant at a predetermined temperature to prevent "slugging" of the refrigerant caused by its increased viscosity. Spot heaters which are placed in contact with the object to be heated may be of a flexible or rigid construction. Such contact spot heaters of a rigid construction (exemplified by that disclosed in U.S. Pat. No. 3,500,444 to Heese et al) are, of course, unsuitable for heating objects having various surface contours since such heaters conform to only a single contour. While pliable spot heaters have been disclosed in U.S. Pat. Nos. 2,052,614 and 1,632,651, these employ heating elements or wires wholly encapsulated within a moisture-proof material of molded rubber or other thermal insulating material. Such heaters are inefficient from the standpoint of heat transfer because the moisture-proof sealing materials in which the heating elements are encapsulated are invariably a good thermal insulation. In addition, such heaters are expensive to manufacture because of the high materials costs of the moisture sealing material used to fully encapsulate the heating element.

Accordingly, it is a principal object of the present invention to provide a spot heater construction which overcomes the drawbacks of the prior art.

It is another object of the present invention to provide a unidirectional heater construction which is relatively simple and economical to manufacture, can be readily installed for heating objects of various contours and which is efficient in operation.

It is a further object of this invention to provide a spot heater composed of separately fabricated individual components which lend themselves to simple assembly procedures.

Still another object of this invention is to provide a highly versatile heater construction of the above type in which the specifications of each component may be separately selected and the components assembled in various combinations thereby providing a highly versatile and economical method of fabricating heaters of maximum efficiency for each particular utility without the necessity of maintaining large inventories of completed heater units.

DESCRIPTION OF THE PREFERRED EMBODIMENT

Figure 1:
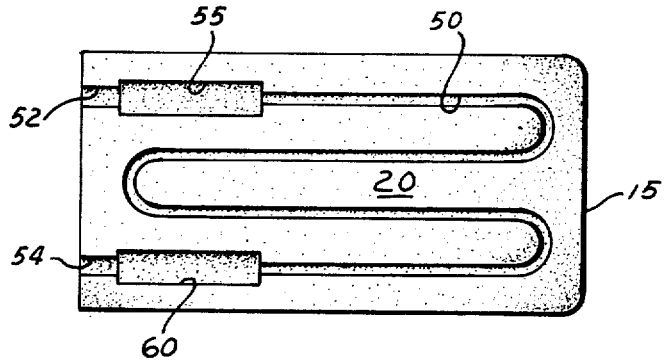
FIG. 1 is a plan view of a portion of a heater of the type embodying this invention.

Referring in detail to the drawings, the spot heater of the present invention is shown generally at 10 and comprises a pliable base or support member 15 which has a flexible insulated heating wire 25 (FIG. 2) supported by the base. As shown, the insulated heating wire 25 is fitted into a groove 50 provided in the base with a portion of the outer cross section of the heating wire over its entire length extending outwardly of a major surface 20 of the base. Electric power is supplied to the heating wire 25 through lead wires 30 and 35 with the connections of these wires to the heater being sealed and insulated as shown at 40 and 45 in FIG. 3. The combination of the pliable base member 15 and the insulated flexible heating wire 25 enable the heater to be applied in conforming surface-to-surface contact with any surface contours of objects to be heated. In use, the outer surface portion of the heating wire is placed in abutting relation against the surface of the object to be heated, thereby providing for maximum heat transfer from the wire to the object being heated. The heater may be held in place by any suitable means, as will hereinafter be described.

As shown, the base 15 is generally rectangular in shape and includes major surface 20 which is provided with a groove 50 adapted to receive and retain heating wire 25. While groove 50 as shown follows a sinuous path from end to end, it will be understood that a groove of any desirable configuration may be employed. In cross section, the groove 50 is of a depth and width dimensionally slightly less than the diameter of heating wire 25, thereby allowing the heating wire to be elastically gripped by the outer edges of the base which define the groove 50. The outer portion of the wire extends slightly outward of major surface 20 of the base. Base 15 is also provided with cavities 55 and 60 which open in the same direction as groove 50. The cavities are substantially larger in cross section than groove 50 and function to freely accommodate the electrical connections between heating wire 25 and lead wires 30 and 35 and to serve as troughs or mold forming means for receiving a molding material in liquid form used to form seals 40 and 45 (FIG. 3) about the connections. The cavities communicate at their inner ends with the terminal ends of groove 50 and at their outer ends communicate with recesses 52 and 54 adapted to receive and grip the diameter of the lead wires 30 and 35. The recesses open through one end wall of the base 15. The liquid molding material is prevented from seeping out of the ends of the cavities by the snug fit of the groove 50 on the heater wire and by the snug fit of recesses 52 and 54 on the lead wires.

Base 15 may be formed by molding any suitable heat resistant material preferably employing one which will provide a pliable and flexible support member for the resistance wire. The base may be formed of rubber or any suitable synthetic plastic having the requisite properties for the particular utility for which the heater is being fabricated. For example, polyvinyl chloride has proved suitable as has thermoplastic rubber which is capable of withstanding temperatures up to 250° F. Moreover, since thermoplastic rubber has a relative low thermal conductivity of about 0.09 BTU/hr. ft °F., it is particularly well suited as molding material for the base portion 15 of heaters embodying this invention. The low thermal conductivity of the base ensures that only minimal amounts of heat will be lost by conduction through the base and away from the area being heated. The disposition of the heating wire outwardly of the surface of the base enables the direct surface-to-surface contact of the heater wire against the object being heated, while the base is disposed outwardly of this interface so that heat generated by the heating wire is almost entirely concentrated onto the object being heated, and retained in this location, its outward escape being prevented by the insulating base member partially encapsulating the heater wire.

Figure 5:
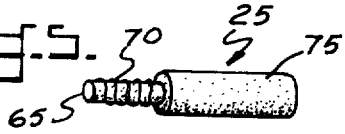
FIG. 5 is a perspective view on an enlarged scale of a heating wire employed in the heater of the present invention with portions of the wire removed to show details of construction.

This heating wire 25, as shown in FIG. 5, comprises a heat resistant flexible core 65 such as fiberglass or the like with an electrical resistance heating wire 70 helically coiled therearound. The core supported wire is fully insulated by a flexible sheath 75 of electrical insulating material of good thermal conductivity and preferably moisture proof. One suitable material for forming the insulating sheath 75 is silicone rubber which is not only an excellent moisture sealing material, but also one which is capable of indefinitely withstanding temperatures as high as 400° F., whereby the heating wire is adaptable to a wide variety of heating requirements. Silicone rubber also has a relatively high thermal conductivity of 0.2 BTU/hr. ft. °F., enabling good heat transfer from the resistance wire 70 through the silicon sheath 75. The insulation 75 may be applied to the resistance wire by extruding the silicone rubber onto the core-supported resistance wire as a continuous process. For heaters of lower watt density, a lower cost vinyl jacket may alternatively be extruded onto the core supported heater wire. Heater wires having any desired performance characteristics may be fabricated by this procedure which is wholly independent of the heater assembly procedure and fabrication of the base component 15. Insulated heater wires may thus be fabricated at one sub-assembly station, base members molded at a second station and final assembly of the two components completed at a third station.

Figure 2:
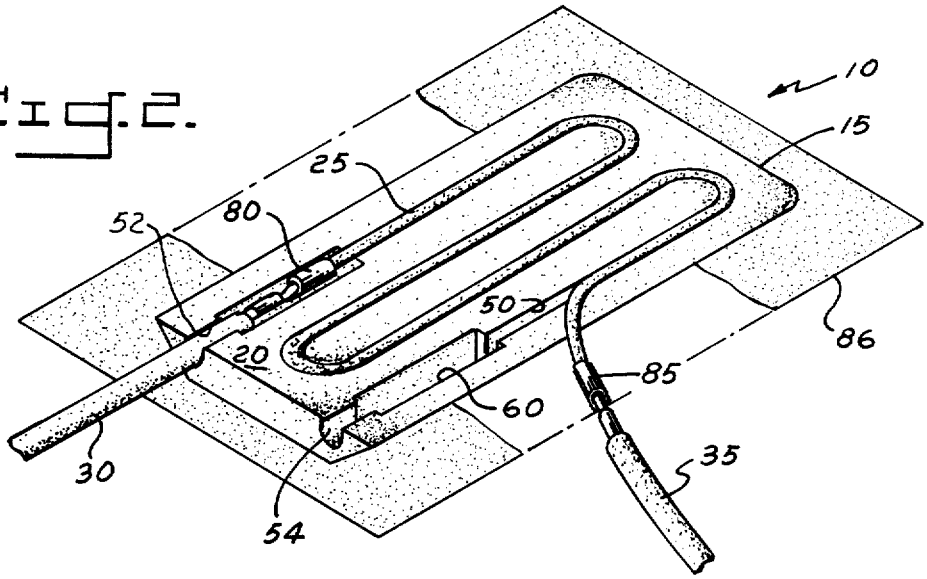
FIG. 2 is a side elevational view of a partially assembled heater of the present invention, illustrative of a step in the process of fabricating such heaters.
Figure 3:
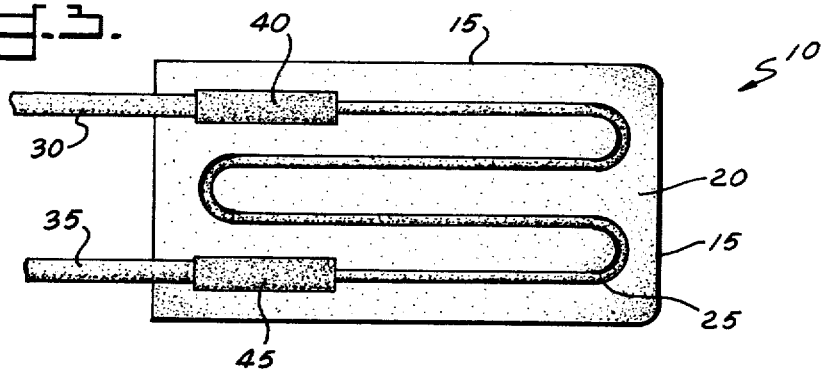
FIG. 3 is a plan view of a spot heater of the present invention.
Figure 4:
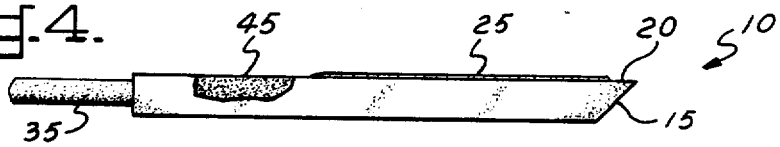
FIG. 4 is a side elevational view of the heater partially broken away to show details of construction.

In the final assembly of heaters embodying this invention, it is only necessary to select a coil of prescribed heating wire and separately selected base components. After cutting the heating wire to predetermined lengths, as shown in FIG. 2, lead wires 30 and 35 are connected to the bared terminal ends of each length of heater wire using crimp connectors 80 and 85. The preinsulated heater wire is then fitted into the groove 50 formed in the base member. Because of the elastic character of the base, it may be easily flexed and manipulated to facilitate fitting of the wire into its sinuous groove. Crimp connectors 80 and 85 as well as portions of heating wire 25 are fitted into cavities 55 and 60 and the lead wires are fitted into recesses 52 and 54 which extend from the outer end of the cavities through one end wall of the base. A curable moisture impervious sealing material is injected into the cavities 55 and 60 and being a liquid flows about connectors 80 and 85 disposed within the cavities. This material may be a pourable liquid silicone rubber, a self-curing epoxy resin or any other composition possessing the required strength, electrical, thermal and moisture sealing properties. Epoxy resin capable of withstanding elevated temperatures and having a relatively high thermal conductivity of 0.5 BTU/hr. ft °F. has been found to be particularly well suited for forming end seals 40 and 45 within the cavities 55 and 60.

Because of its pliable overall construction, the heater of the present invention is ideally adapted for surface-to-surface mounting onto objects of almost any external configuration. In use, the heater is placed against the object to be heated with the heating element 25 in contact with the surface of the object and the support member facing outwardly. The heater may be held in place by means of an adhesive coated metallic foil tape 86. Preferably, the tape 86 is of sufficient overall size to cover the outer surface of the base with its marginal edges extending outwardly of the edges of the base for adhesively bonding to the surrounding surface of the object to be heated. The direct contact of heating wire 25 with the object provides for efficient heat transfer to the surface being heated because of the good thermal conductivity of the silicone or other suitable insulation 75. On the other hand, the low thermal conductivity of base 15 insures that only minimal amounts of heat will be lost be the conduction away from the object being heated. The metallic foil tape further cooperates in preventing outward heat loss.

Since the heater of the present invention is constructed so that its heating element may be placed in direct surface-to-surface contact with the object being heated, materials having optimum properties can be used in each of the separately fabricated heater components. Thus, a low cost base material will be selected for its heat resistance and low thermal conductivity whereby the loss of heat by conduction away from the object being heated is minimized. This does not, however, adversely affect heat transfer from the heating element, since it is only partially embedded in the support or base member and is operated in direct contact with the object being heated. Moreover, the insulation selected for use on the heating element is one with sufficient heat resistance to withstand the operating temperatures of the particular resistance wire. The insulation must also possess moisture sealing properties and good thermal conductivity. In this regard, silicone rubber, though an excellent insulating material, is relatively costly and if used for wholly encapsulating the heater would result not only in much more expensive heaters, but they would also lack the directional thermal conductivity of the heater embodying this invention.

While there has been shown and described a specific embodiment of the spot heater of the present invention and a method for forming that heater, it will be understood that modifications may be made without departing from this invention and it is intended by the following claims to cover such modifications as come within the true spirit and scope of this invention.

What is claimed is:

1. A unidirectional electrical resistance heater comprising an electrical resistance wire insulated throughout its length by a sheath of moisture impervious electrical insulation, said resistance wire having terminal ends each being connected to an electrical lead wire, a support member formed from an elastomeric material, said electrical resistance wire being partially embedded in a major surface of said support member, said support member being formed of a material having a lower thermal conductivity than the insulation forming the sheath of said electrical resistance wire and provided with a cavity dimensioned to accommodate the interconnected portions of each lead wire and the resistance wire, said electrical resistance heater further comprising a moisture impervious material disposed within each cavity encapsulating said connections.

2. A unidirectional electrical resistance heater comprising a support member in the form of a molded pad of elastomeric material including a continuous groove opening into a major surface of said pad and a pair of cavities communicating with the terminal ends of said groove, an electrical resistance wire insulated throughout its length by a sheath of moisture impervious insulation, said wire being disposed in said groove, the diameter of said wire being not less than the depth of said groove whereby the outer surfaces of wire are exposed for direct contact with a surface to be heated and an insulated lead wire electrically connected to the terminal ends of said resistance wire, each of the connections being disposed in one of said cavities, said connections being encapsulated and sealed within a body of moisture impervious material confined within said cavities.

3. A unidirectional electrical resistance heater as set forth in claim 1 wherein the elastomer forming said support member is a thermoplastic rubber and the insulating sheath of said resistance wire is a silicone rubber.

4. A unidirectional electrical resistance heater as set forth in claim 2 in which the elastomeric material of which said support member is formed has a substantially lower thermal conductivity than the insulation forming the sheath of said electrical resistance wire.

5. A unidirectional electrical resistance heater as set forth in claim 4 in which the material encapsulating said connections comprises a cured moisture impervious synthetic plastic resin and said support member including a recess extending from the outer end of each cavity through an edge of said support member, each said recess being adapted to receive therein a portion of each lead wire adjacent said interconnection, said groove being generally circular in cross section whereby the upper edges thereof retain said resistance heater wire within said groove.

* * * * *